US006584717B2

(12) United States Patent
Cinquina

(10) Patent No.: US 6,584,717 B2
(45) Date of Patent: Jul. 1, 2003

(54) PHOTOGRAPH-HOLDER MADE OF FLEXIBLE SHEET MATERIAL AND PUNCHED SHEET FOR THE MANUFACTURE THEREOF

(76) Inventor: Giuliano Cinquina, Via del Trabocco 3, Spoltore (Pescara) (IT)

( * ) Notice: Subject to any disclaimer, the term of this patent is extended or adjusted under 35 U.S.C. 154(b) by 0 days.

(21) Appl. No.: 09/906,960

(22) Filed: Jul. 16, 2001

(65) Prior Publication Data

US 2001/0047606 A1 Dec. 6, 2001

Related U.S. Application Data

(63) Continuation of application No. PCT/IT00/00449, filed on Nov. 9, 2000.

(30) Foreign Application Priority Data

Nov. 16, 1999 (IT) ..... PE99A0025

(51) Int. Cl.[7] ..... A47G 1/06

(52) U.S. Cl. ..... 40/774; 40/786; 40/788; 40/789

(58) Field of Search ..... 40/774, 775, 786, 40/789, 788; 229/107, 116.1; 206/27, 22, 15, 45.21, 48.8

(56) References Cited

U.S. PATENT DOCUMENTS 5,822,896 A 10/1998 Milstein
6,427,371 B2 * 8/2002 Olson et al. ..... 40/789

FOREIGN PATENT DOCUMENTS

| | | | | |
|---|---|---|---|---|
| DE | 2 054 163 | * | 5/1972 | ..... 40/FOR 100 |
| DE | 297 08 284 U1 | | 7/1997 | |
| DE | 299 10 151 U1 | | 11/1999 | |
| GB | 661432 | * | 11/1951 | ..... 40/152.1 |
| GB | 1 364 149 | | 8/1974 | |
| GB | 1364149 | * | 8/1974 | ..... 40/FOR 100 |

* cited by examiner

*Primary Examiner*—Cassandra H. Davis
(74) *Attorney, Agent, or Firm*—Akin Gump Strauss Hauer & Feld, L.L.P.

(57) ABSTRACT

A photograph-holder substantially formed of a suitably folded punched sheet, comprising a substantially quadrangular framing face (4) provided with a window (1) and superimposed to a bearing face (10) which has the same shape and size and is contiguous to a reinforcing face (12) also having the same shape and size and a supporting face (7) interposed in a non-flat position between the framing face (4) and the bearing face (10), the framing face (4) being provided with two side flaps (2, 3) bent inwards and inserted between the bearing face (10) and the reinforcing face (12). The elastically flexible punched sheet material has a substantially rectangular shape and is provided with folding lines (8, 9, 11) parallel and perpendicular to the longest sides of the rectangle which define respectively the framing face (4), which is contiguous to the supporting face (7), which is contiguous to the bearing face (10), which is contiguous to the reinforcing face (12), said framing face (4) being provided with the window (1) and with two side flaps (2, 3) which can be folded towards the center of face (4) along two folding lines (5, 6) coinciding with the longest side of the rectangular sheet.

6 Claims, 5 Drawing Sheets

A

B

C

PHOTOGRAPH-HOLDER MADE OF FLEXIBLE SHEET MATERIAL AND PUNCHED SHEET FOR THE MANUFACTURE THEREOF

CROSS-REFERENCE TO RELATED APPLICATION

This application is a continuation of International Application No. PCT/IT00/00449, filed Nov. 9, 2000, the disclosure of which is incorporated herein by reference.

BACKGROUND OF THE INVENTION

The present invention relates to a type of photograph-holder made of an elastically flexible, preferably ecological sheet, as well as a punched sheet for the mounting thereof.

The presently known photograph-holders are of various type and made of wood, metal, plastic and other materials of different rigidity and weight. The rigidity of a photograph-holder can be a drawback, for example when it is desired to have on oneself the photograph-holder with the photograph of a loved person. In these circumstances also the weight of the photograph-holder can be a drawback, and anyway it is such when it is desired to send the photograph-holder, for instance by mail.

BRIEF SUMMARY OF THE INVENTION

An object of the present invention is therefore to provide a photograph-holder free from the above mentioned drawbacks. Another object of the present invention is to provide a punched sheet for the manufacture of said photograph-holder. Said objects are achieved according to the present invention with a photograph-holder having the features specified in claim 1 and a punched sheet having the features specified in claim 6.

An advantage of the present invention is that the photograph-holder which is the subject matter thereof, besides being flexible and; light, is made of a very economical material such as a paper board or a plastic sheet, and does not require other members for its assemblage.

Another advantage of the present invention is that the photograph-holder which is the subject matter thereof can be completely made of paper material and therefore is not polluting.

A further advantage of the present invention is that the punched sheet material which is the subject matter thereof is very thin and can be piled up in a small space, thus allowing considerable reductions of transport and storage costs.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
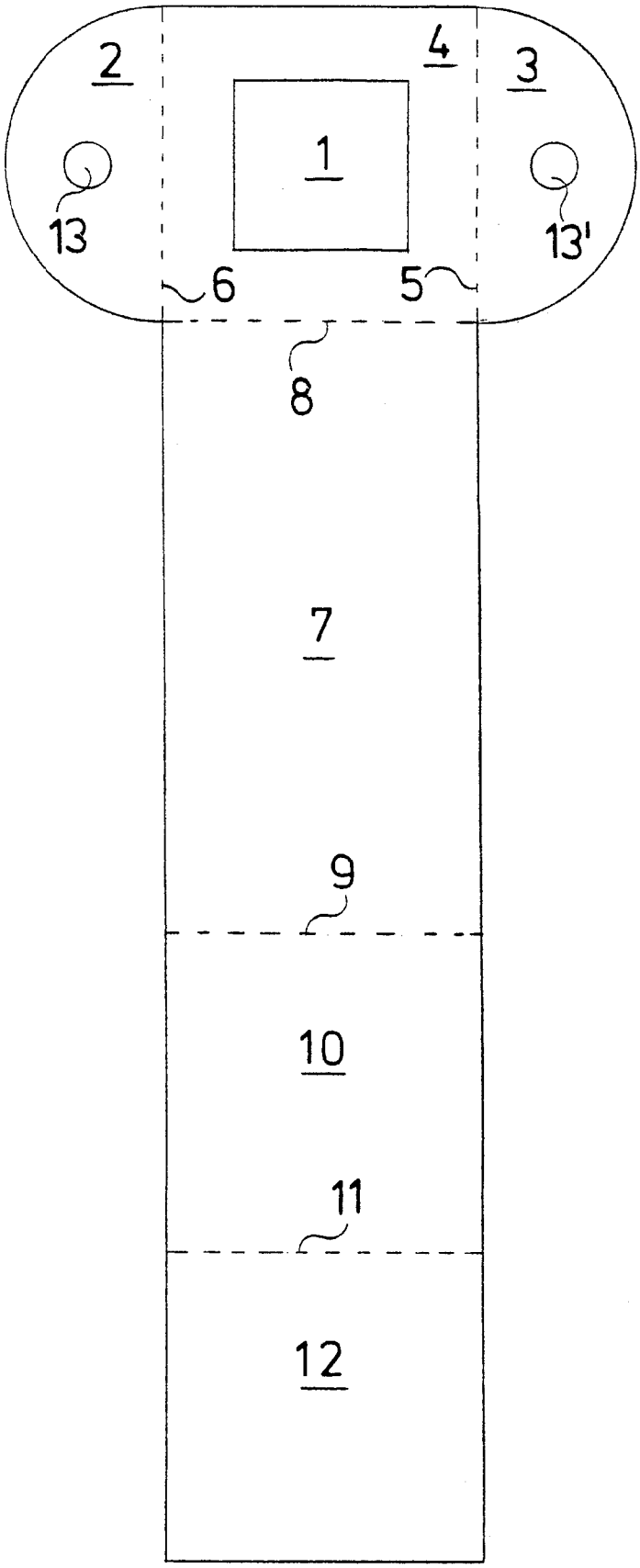
FIG. 1 shows a plan view of the punched sheet material according to the present invention.

With reference to FIG. 1 there is shown that the sheet material to be used for manufacturing the photograph-holder according to the present invention has an elongated, substantially rectangular shape and is provided with a window 1 next to one of the two ends of the sheet, and of two side flaps, 2 and 3 respectively, protruding from the sides of the sheet, substantially near to said window 1.

Figure 2:
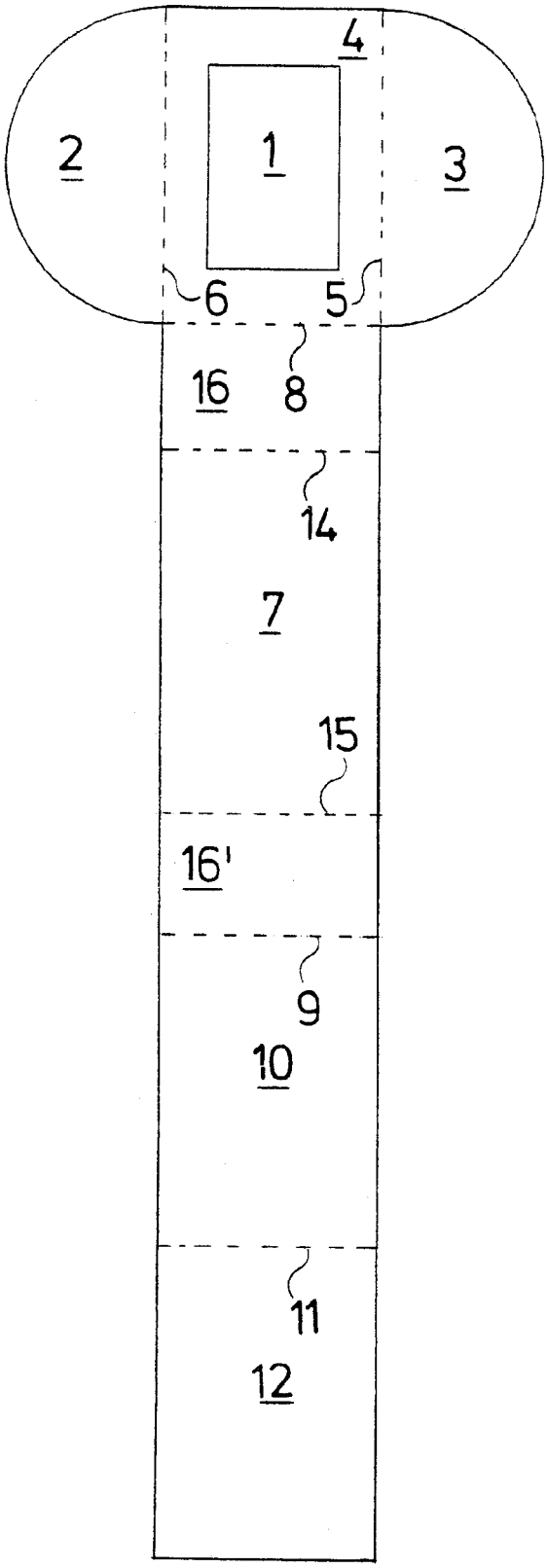
FIG. 2 shows a different embodiment of the punched sheet material according to the present invention.
Figure 3:
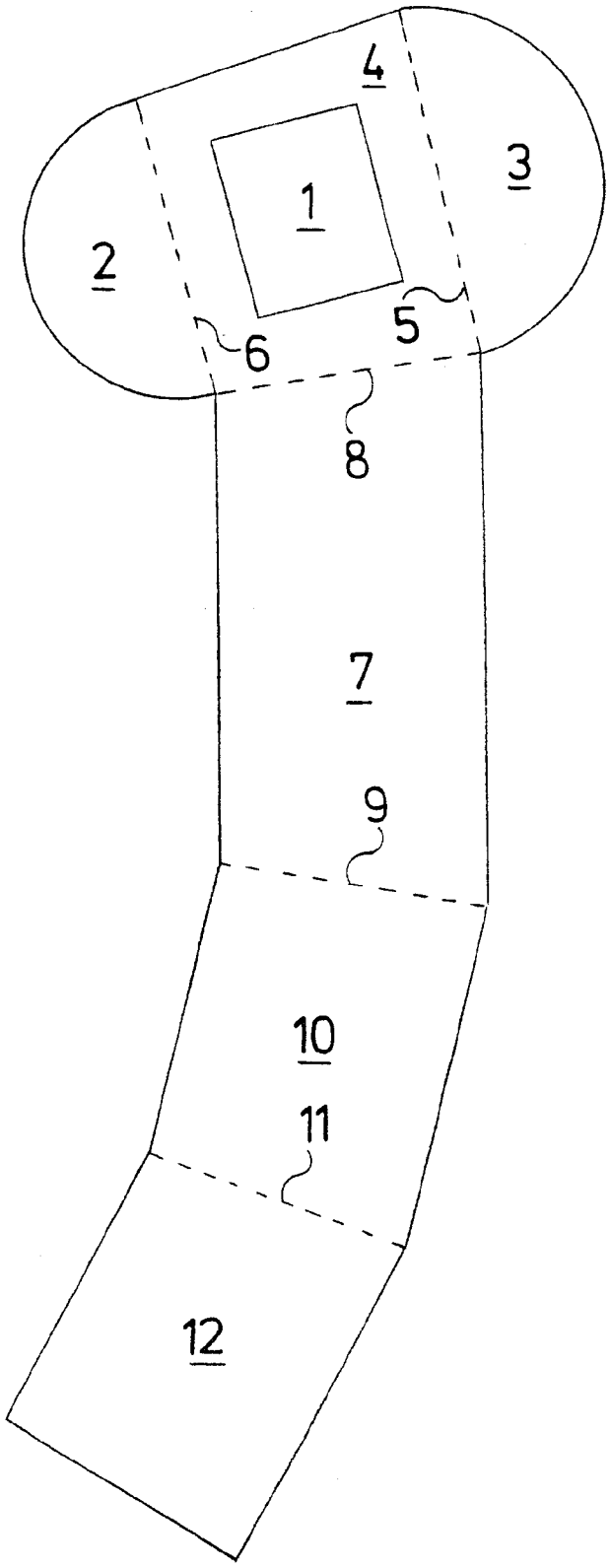
FIG. 3 shows a plan view of a further different embodiment of the punched sheet material according to the present invention.

The sheet portion on which window 1 has been punched and which is provided with side flaps 2 and 3, is substantially square in FIG. 1, but it can also be rectangular as shown in FIG. 2, or trapezoidal as in FIG. 3. Window 1 can be square, rectangular, round, curved or having any other desired shape.

The sheet portion provided with window 1 performs mainly the function of a frame and therefore can be defined as framing face 4. Framing face 4 is connected to side flaps 2 and 3 along folding lines 5 and 6 respectively.

Framing face 4 is connected to the contiguous, substantially rectangular face 7 along folding line 8. Face 7 can be defined supporting face 7 because of one of the functions that it performs in the photograph-holder.

Supporting face 7 is connected along folding line 9 to a face 10 having shape and size substantially identical to those of face 4. In fact, in the mounted photograph-holder, face 10 will be superimposed to face 4 and will act as a support for the photograph which will be interposed between said bearing face 10 and the framing face 4. In such a position the photograph will be visible from the outside through window 1.

Bearing face 10 is connected along folding line 11 to face 12 which is positioned in the sheet end portion opposed to that of face 4. Because of its reinforcing function in the structure, face 12 can be defined as reinforcing face. In fact, in the mounted photograph-holder, reinforcing face 12 is intended to hold side flaps 2 and 3 in the folded position so as to prevent them from opening apart. Flaps 2 and 3, once folded inside behind bearing face 10, press the latter against framing face 4 and bearing face 10. Supporting face 7, in addition to holding elastically in a fixed position all the components of the photograph-holder, has also the function of a support for the latter when it is laid on a table.

In FIG. 1 the side flaps 2 and 3 are provided with holes 13 and 13' whose function is facilitating the assemblage of the photograph-holder. Other holes can be provided on the other faces, both for making the structure lighter and for facilitating the assembling operations of the photograph-holder.

Now, with reference to FIG. 2 there is shown that the punched sheet according to the present invention can be modified for a particular use. Said punched sheet has been modified for obtaining a photograph-holder suitable for being sent by mail in a standard envelope for letters. For this purpose, framing face 4 is not of a square shape, but rectangular. It is also provided with a window 1 and with two side flaps 2 and 3 which perform the same functions described with reference to FIG. 1. The same must be said about bearing face 10 and reinforcing face 12 of the sheet of FIG. 2, which perform the same functions of the analogous faces described with reference to FIG. 1.

The substantial difference between the punched sheet illustrated in FIG. 1 and that of FIG. 2 is represented by supporting face 7. In fact, when the photograph-holder is mounted, face 7 of the sheet of FIG. 1 is intended to remain curved as a semicircle, whereas face 7 of the sheet of FIG. 2 is intended to remain folded twice at an angle. For this purpose face 7 of FIG. 2 is provided with two additional folding lines 14 and 15, parallel to each other and to folding lines 8 and 9 which define two smaller faces 16 and 16'. In the mounted photograph-holder the portion of face 7 comprised between folding lines 9 and 15, which form the smaller face 16', will work as a base of the photograph-holder.

All the folding lines are obtained by simple edging of the punched sheet material. The structure of the sheets illustrated in FIGS. 1, 2 and 3 can be slightly modified in order to confer a particular aesthetic value to the mounted photograph-holder or for further facilitating the mounting operations. For example, one of the sides of supporting face 4 can be designed arched towards the outside so as to form a kind of curved fronton in the background of framing face 4 when the photograph-holder is mounted. Another optional variation consists for example in slightly arc-shaping both sides of face 7 of the punched sheet of FIG. 2 so as to facilitate the assemblage of the photograph-holder. Again, if it is desired that framing face 4 is not substantially perpendicular to the bearing face, but inclined with respect to it, the bearing side of supporting face 7 can be designed arched towards the inside.

Figure 4:
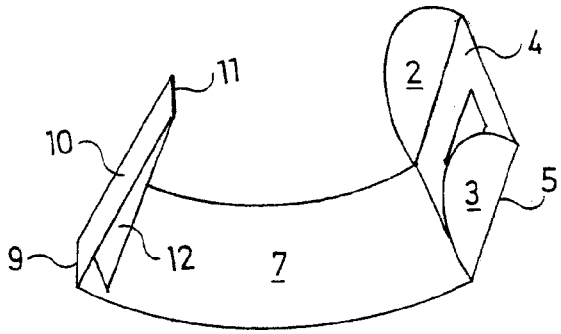
FIG. 4 shows a sequence of the folding operations of the sheet material up to the obtainment of the photograph-holder according to the present invention.
Figure 4:
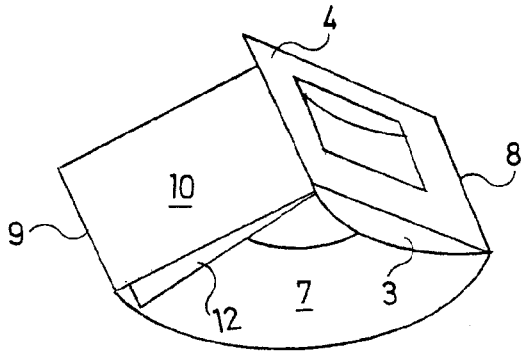
Figure 4:
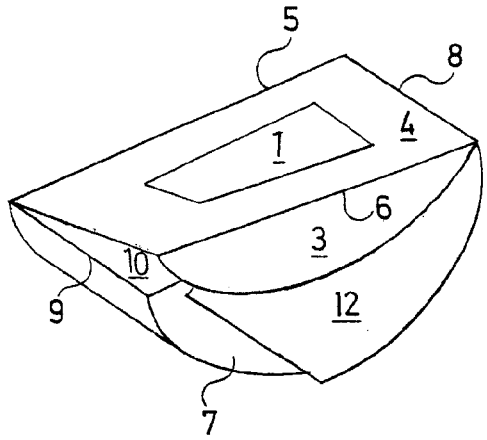
Figure 5:
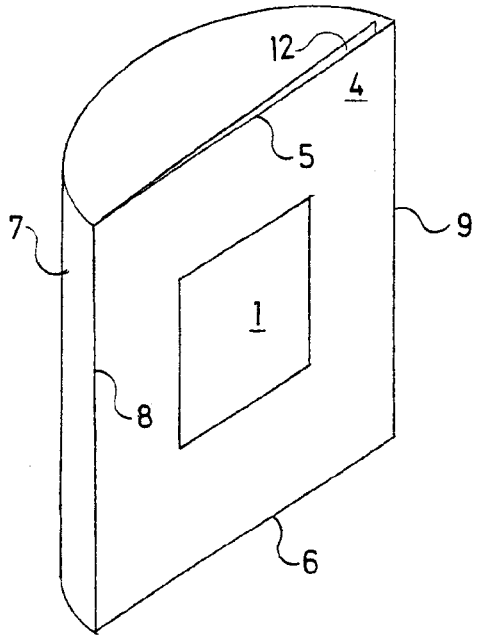
FIG. 5 shows a perspective view of a photograph-holder according to the present invention obtained with the sheet of FIG. 1.

FIG. 4 graphically shows with the illustrations A to C the various folding-up phases of the punched sheet material of FIG. 1 up to the formation of the photograph-holder according to the present invention, shown in FIG. 5. Illustration A shows the punched sheet of FIG. 1 wherein the reinforcing face 12 has been folded along line 11 until it turns completely over face 10 and both have been folded along line 9 and lifted, thus causing a slight bending of supporting face 7. Illustration B shows that also framing face 4 has been lifted and contacted with folding line 11, thus causing a further bending of supporting face 7. At the same time a slight separation of face 12 from face 10 has occurred, and the free space which has been created between them will be useful for inserting the side flaps 2 and 3. In order to facilitate said insertion, face 10 must be progressively brought towards framing face 4 until it rests against the back thereof, as shown in figure C. Once that side flaps 2 and 3 are completely inserted between faces 10 and 12, they will press face 10 against framing face 4, between which the photograph is interposed.

FIG. 5 shows the photograph-holder according to the present invention obtained with the punched sheet of FIG. 1 folded as shown in FIG. 4. There is shown window 1, intended to make visible from the outside the photograph comprised between framing face 4 and bearing face 10. The figure also shows reinforcing face 12 and supporting face 7 in its semicircle-curved position. In said position face 7, besides holding the photograph-holder standing on a table, exerts an elastical thrust towards the outside which, by cooperating with the other structural members of the photograph-holder, confers to the latter stability and functional effectiveness.

Figure 6:
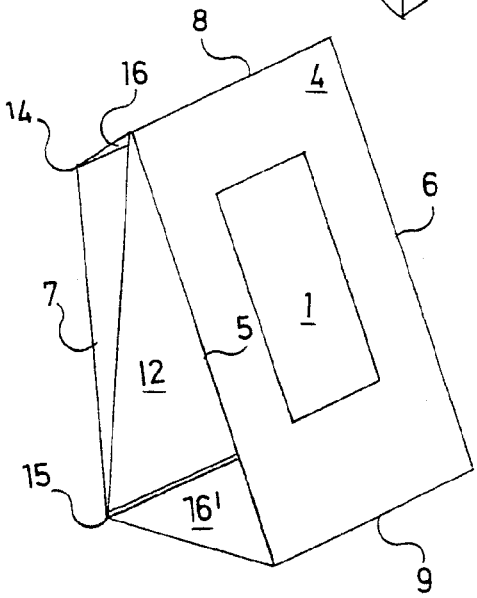
FIG. 6 shows a perspective view of a photograph-holder according to the present invention obtained with the sheet of FIG. 2.

FIG. 6 shows the photograph-holder according to the present invention in the version that can be sent by mail. In the figure there is shown that face 12, when the assemblage si finished, is positioned diagonally with respect of the trapezoidal prism defined by the further folding of the supporting face 7 along the additional folding lines 14 and 15. Face 16' works as a base of the photograph-holder whose framing face 4 will be inclined upwards and stably supported by reinforcing face 12. A thin transparent plastic sheet for protection of the photograph can be advantageously inserted between the external surface of the photograph and the internal face of framing face 4.

Essential feature of the photograph-holder of FIG. 6 is that it can be easily carried in a flat position in order to be inserted in the mailing envelope. In order to obtain this, it is sufficient to pull the side flaps 2 and 3 off, opening them completely, to fold them again, this time on the back of reinforcing face 12, and finally to pull framing face 4 and faces 7 and 10 laterally in opposite directions, acting with two fingers on the corners defined by the ends of folding lines 8 and 9.

Figure 7:
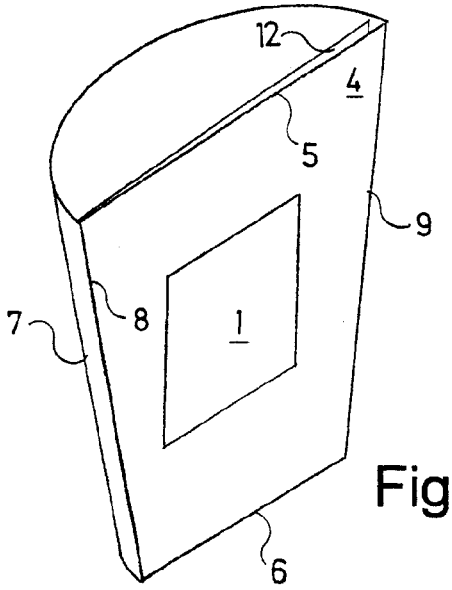
FIG. 7 shows a perspective view of a photograph-holder according to the present invention obtained with the sheet of FIG. 3.

FIG. 7 shows the photograph-holder according to the present invention obtained with the punched sheet of FIG. 3, that is, in the version with framing face 4 of trapezoidal shape.

The photograph-holder according to the present invention can be made of any flexible sheet material suitable for this purpose. For obvious ecological advantages, paper board is certainly the preferred material. This material is usually provided with a sufficient rigidity which allows the structural portions of the photograph-holder to bend elastically in the mounting and demounting operations which can be repeated many times.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A photograph-holder substantially formed of a suitably folded punched sheet material, characterized in that it comprises a substantially quadrangular framing face (4) provided with window (1) and superimposed to a bearing face (10) having the same shape and size and contiguous to a reinforcing face (12) also of the same shape and size and a supporting face (7) interposed in a non-flat position between the framing face (4) and the bearing face (10), the framing face (4) being provided with two side flaps (2, 3) bent inwards and inserted between the bearing face (10) and the reinforcing face (12).

2. A photograph-holder according to claim 1, characterized in that the supporting face (7) is in semicircle-curved position.

3. A photograph-holder according to claim 1, characterized in that the supporting face (7) is bent at an angle along two parallel folding lines (14, 15).

4. A photograph-holder according claim 1, characterized in that it has the framing face (4) of rectangular shape and size such that the photograph-holder can be inserted in a standard mailing envelope.

5. A photograph-holder according to claim 1, characterized in that it is provided with one or more holes on one or more of the faces (7, 10, 12) and of the flaps (2, 3).

6. An elastically flexible punched sheet material characterized in that it has a substantially rectangular shape and is provided with folding lines (8, 9, 11), perpendicular to the longest sides of the rectangle, which define respectively a framing face (4), which is contiguous to a supporting face (7), which is contiguous to a bearing face (10), which is contiguous to a reinforcing face (12), said framing face (4) being provided with a window (1) and two side flaps (2, 3) which can be folded towards the inside of the face (4) along two folding lines (5, 6) coincident with the longest side of the rectangular sheet, said faces (4, 10, 12) having a rectangular shape and substantially the same size and said supporting face (7) being provided with two additional folding lines (14, 15) parallel to the folding lines (8, 9) and equidistant therefrom in order to define two smaller faces (16, 16') inside the supporting face (7).

* * * * *